United States Patent [19]

Beckerman et al.

[11] 4,242,976

[45] Jan. 6, 1981

[54] PRECISE POSITIONER OF BUTTONHOLE PRESSER FOOT

[75] Inventors: Howard L. Beckerman, Middletown; Russell J. Pepe, Piscataway; Allan M. Dob, Clifton, all of N.J.

[73] Assignee: The Singer Company, Stamford, Conn.

[21] Appl. No.: 126,087

[22] Filed: Feb. 29, 1980

[51] Int. Cl.[3] ..... D05B 3/06

[52] U.S. Cl. ..... 112/264.1

[58] Field of Search ..... 112/264.1, 158 B, 77, 112/76, 70, 73, 235

[56] References Cited

U.S. PATENT DOCUMENTS

| | | | |
|---|---|---|---|
| 4,181,087 | 1/1980 | Brauch et al. | 112/264.1 |
| 4,196,680 | 4/1980 | Edwards | 112/77 |

*Primary Examiner*—Peter P. Nerbun

*Attorney, Agent, or Firm*—Edward P. Schmidt; Robert E. Smith; Edward L. Bell

[57] ABSTRACT

For a zigzag sewing machine having a buttonhole presser device allowing formation of a buttonhole in a single step, a method for insuring that the presser device is in its initiating position by determining where the movable portion of the presser device is and, if it is not in its correct position, to adjust feeding action required to move it to its correct position.

1 Claim, 8 Drawing Figures

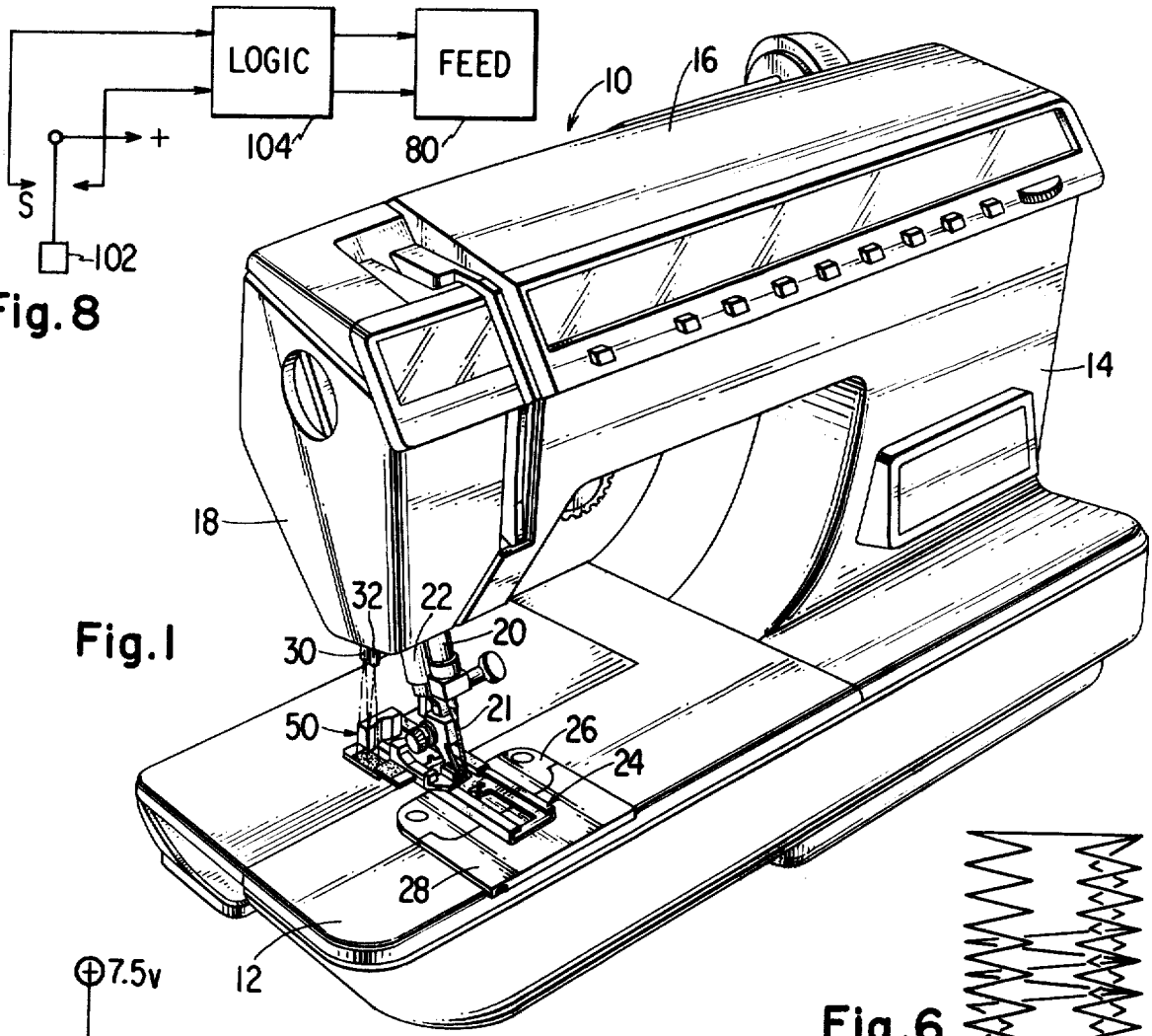
Fig. 8
Fig. 1
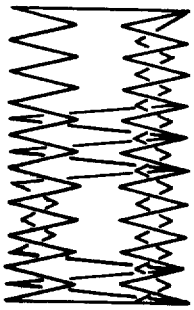
Fig. 6
PRIOR ART
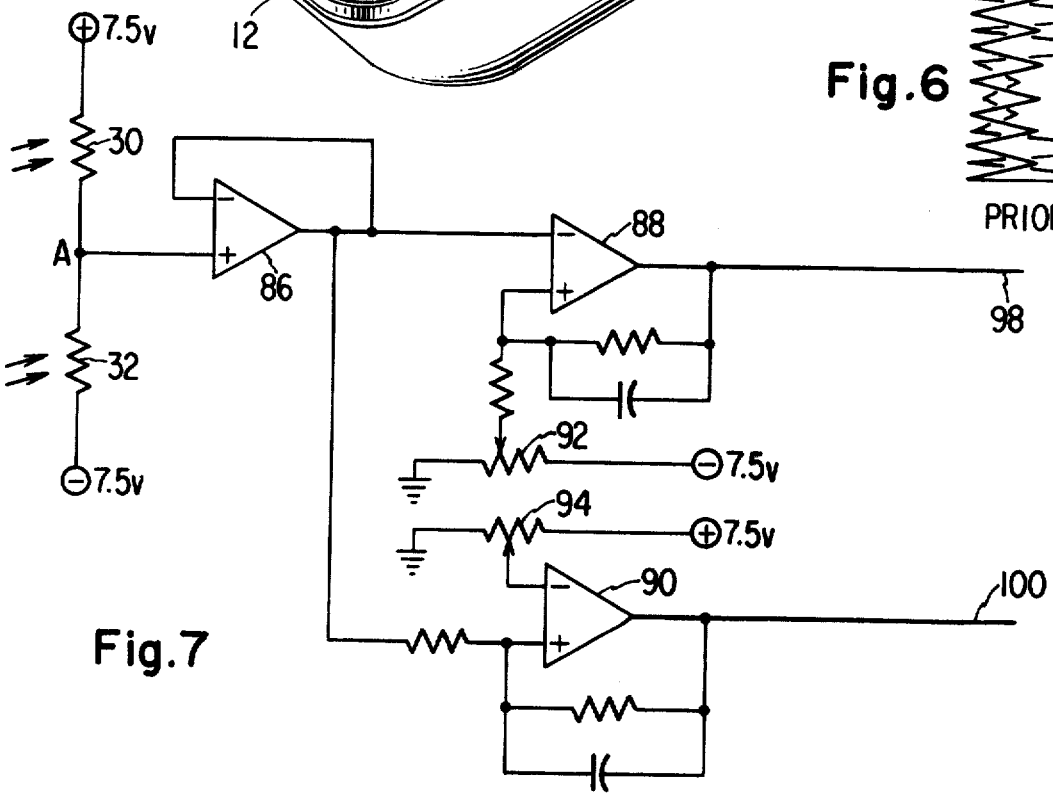
Fig. 7

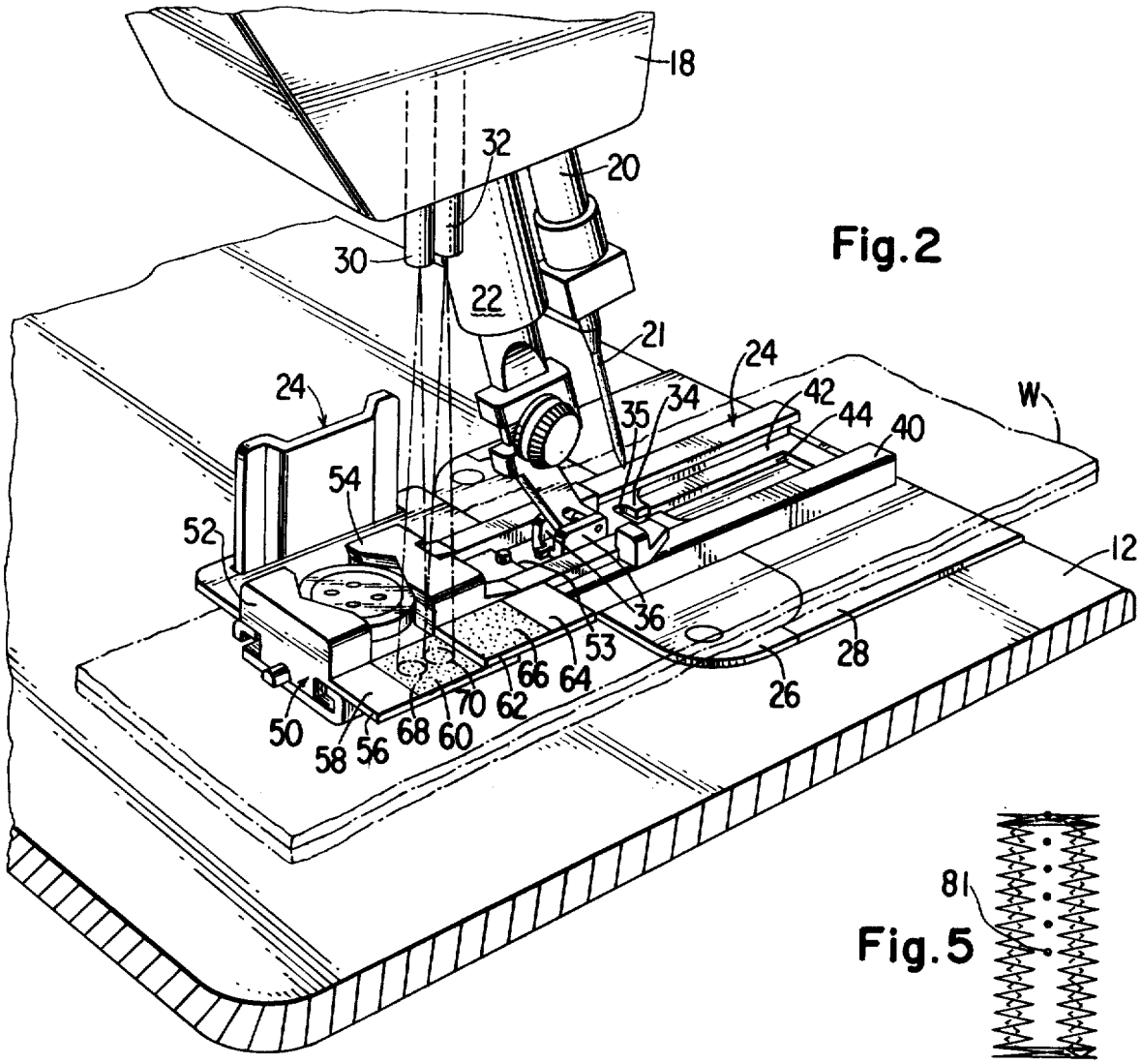
Fig.2
Fig.5
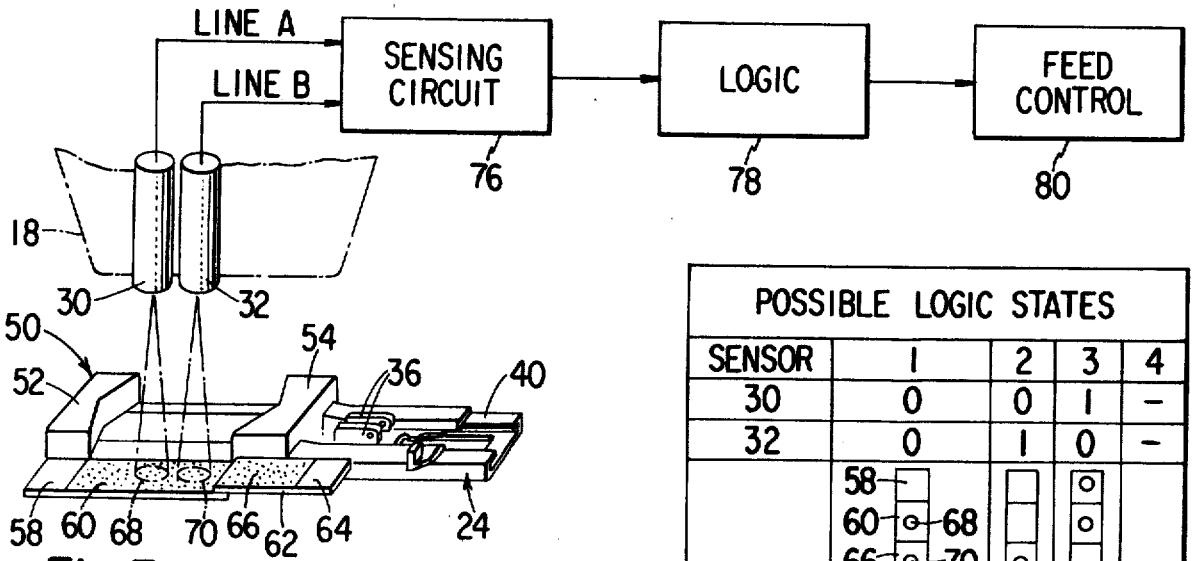
Fig.3
| POSSIBLE LOGIC STATES | | | | |
|---|---|---|---|---|
| SENSOR | 1 | 2 | 3 | 4 |
| 30 | 0 | 0 | 1 | – |
| 32 | 0 | 1 | 0 | – |
| | 58, 60–68, 66–70, 64 | | | |
Fig.4

PRECISE POSITIONER OF BUTTONHOLE PRESSER FOOT

BACKGROUND OF THE INVENTION

This invention is concerned with sewing machines, more particularly, with a device for initially positioning a travelling buttonhole foot utilized for accomplishment of a one step buttonhole, into a proper position.

It is known in the prior art, to use presser devices for sewing buttonholes in which a portion of the presser device clamps the work material and travels therewith during the accomplishment of the buttonhole. Such a device is shown in U.S. Pat. No. 3,877,403 issued on Apr. 15, 1975 to Ketterer. In that patent there is disclosed a buttonhole presser device having a presser foot which may be connected to a presser bar and carry slidably thereon a work engaging shoe. The work engaging shoe is attached to the presser foot by a spring, for example, so as to have a preferred position with respect thereto.

In operation, the above described buttonholing presser foot was spring biased to an initiating position so that when an operator lowered the presser foot, the entire assembly was in its initiating position. Actually, it frequently became necessary to reposition the work material, which repositioning was sometimes accomplished by an operator by tugging thereupon. Quite frequently the effect was that the buttonhole foot was moved away from its initiating position with the result that an improper buttonhole could be effected wherein the initial bartack was not in the proper position causing an overlap or a short fall of the buttonhole legs to the bartack. An attempt to solve this problem was disclosed in U.S. Pat. No. 4,181,087 issued on Aug. 11, 1978, to Brauch et al in which, prior to initiating stitching upon a buttonhole, operation of the needle bar was suspended and operation of the feed system took place in a direction to place the work engaging shoe of the buttonhole in its initiating position. If the work engaging shoe was already in its initial position, there would only be slippage between the work engaging shoe and the feed dog. As a matter of practicality, however, a limit had to be placed on the amount of feed steps taken to place the work engaging shoe in its initiating position. If the buttonhole foot is mispositioned more than the selected number of feed steps from the mechanical backstop a partially open buttonhole will be stitched. In most cases, this mistake is not noticed until the buttonhole is almost completed, leaving a difficult thread removal job and a question in the operator's mind as to whether the machine is defective.

What is required is some means for actuating the feed system in the right direction for just that amount of time necessary to place the work engaging shoe in its initial position as the first step to the manufacture of a buttonhole.

SUMMARY OF THE INVENTION

The above desired end is achieved in a sewing machine having optical sensing means which operate with manually adjustable button gauging elements on a buttonhole presser device. Such a device is shown in U.S. patent application Ser. No. 059,865, filed July 23, 1979, in which is disclosed an optical sensor means directed towards a button gauging element having a fixed reflective and non-reflective area, and a second reflective area on a slidable portion of the button gauging element, the reflective areas of which may be utilized to indicate the initial point and the end point of a buttonhole so that automatic turn around may take place.

For the present system, a pair of optical sensors are also provided aimed at points slightly separated along the feed direction on the button gauging element. Each optical sensor, A or B, may view a reflective area or a non-reflective area in four possible combinations. There is one correct position, for example, where optical sensor A detects a reflective strip and optical sensor B detects a non-reflective strip. Where optical sensor A detects a non-reflective strip, regardless of what optical sensor B detects, the buttonhole presser device is mispositioned. A logic may be responsive to the output from the sensors to inhibit endwise reciprocation of the needle bar and initiate feeding of the work engaging shoe only until such time as the work engaging shoe is located at its initial position. Thereupon, reciprocation of the needle bar is reinitiated and the buttonhole may begin to be implemented.

DESCRIPTION OF THE DRAWINGS

The invention will be described by reference to the accompanying drawings in which:

FIG. 1 is a perspective view of a sewing machine in which the invention may be applied;

FIG. 2 is a perspective view of a buttonhole gauging presser device of the invention as attached to the sewing machine shown in FIG. 1;

FIG. 3 is a perspective view of the sensors and a portion of the buttonhole presser device showing their attachment to an electronic circuitry in block form;

FIG. 4 is a truth table for the logic indicating the possible states of the optical sensors;

FIG. 5 is a representation of the buttonhole pattern and initial corrections effected by the method of this invention;

FIG. 6 is a representation of the buttonhole pattern which might be implemented without this invention;

FIG. 7 is a schematic circuit diagram of an optical control circuit which is responsive to stimulation of the optical sensors to provide an output to the logic; and, FIG. 8 is a schematic representation of a mechanical switch arrangement by which the method of this invention may also be implemented.

Referring now to FIG. 1, there is shown a sewing machine 10 fashioned with the usual work supporting bed 12 having at one end thereof a standard 14 rising therefrom to support a bracket arm 16 in overhanging relationship to the bed. The bracket arm 16 terminates in a head 18, within which there is supported for endwise reciprocation a needle bar 20 having a sewing needle 21 affixed to the end thereof, and a presser bar 22 terminating in a buttonhole presser device 24. The sewing needle 21 reciprocates through an aperture (not shown) in a throat plate 26 supported on the bed 12 of the sewing machine. A bed slide plate 28 is situated ahead of the throat plate 26 and provides support for the work material and may be slid away to expose inner portions of the sewing machine for maintenance, in a manner well known in the sewing machine art. Visible also in FIG. 1, are optical sensor A 30, and optical sensor B 32, the operation of which will be more fully explained below.

Referring now to FIG. 2, there is shown a perspective view of the buttonhole presser foot 24 and a portion of the head end 18 of the sewing machine. The presser device 24 comprises a presser foot 34 pivotally attached to the presser bar 22. The presser foot 34 has a needle aperture 35 formed therein through which the needle 21 reciprocates in the formation of stitches. Slidably embracing the presser foot 34 is a work engaging shoe 40 having a flat sole portion 42 which underlies the presser foot 34 and overlies the feed dogs (not shown). Formed in the sole portion 42 is a longitudinal slot 44 for providing clearance for needle reciprocation during buttonhole stitching. Attached to the rearward portion of the work engaging shoe 40 is a button gauging device 50 which comprises a first jaw 52 of a button holder fixedly mounted at the end of the work engaging shoe 40 and a second jaw 54 slidably disposed on the work engaging shoe 40 opposite the first jaw 52 whereby a button placed therebetween would be grasped by sliding the second jaw 54 toward the first jaw 52. Attached to the first jaw 52 so as to overhang the work engaging shoe 40 is a first extension 56 extending in the feed direction and having a rear upwardly facing reflecting area 58 and a forwardly disposed upwardly facing non-reflecting area 60. The second jaw 54 is formed with a second extension 62 similar to the first extension 56 and overlying the first extension, which second extension 62 has a forwardly disposed reflecting area 64 and a rearwardly disposed non-relecting area 66. Since this second extension 62 moves with the second jaw 54, the amount of overlap between the first extension 56 and the second extension is a function of the size of the button introduced between the jaws.

The optical sensors 30, 32 are aligned with the first extension 56 and second extension 62 so as to receive light reflected from the surface areas of these extensions. Accordingly, if the reflecting area 58 of the first extension 56 is situated beneath the optical sensor 30, and if the non-reflecting area 60 is situated between the optical sensor 32, these sensors would respond differently since one is receiving light from a reflecting area at a higher rate than the other is receiving light from a non-reflecting area. In FIGS. 2 and 3 the optical sensors 30, 32 are shown to be receiving light reflected from targets 68, 70, respectively, of non-reflecting area 60.

A fuller understanding of the inner workings of the buttonhole presser device 24 may be had by reference to U.S. Pat. Nos. 3,877,403 and 4,091,752, both of which are assigned to the assignee as the instant invention, and both of which are incorporated herein by reference. From a reading of these referenced patents it will be understood that the presser foot 34, which is retained in one position by its connection to the presser bar 22, is connected by a spring (not shown) to the work engaging shoe 40 so that the work engaging shoe is continually urged to a forwardly direction. Thus, whenever the buttonhole presser device 24 is elevated out of contact with the bed 12 of the sewing machine and the feed dogs (not shown) protruding therefrom, the work engaging shoe 40 will move forwardly until the cheek pieces 36 of the presser foot 34 abut the inner terminus 53 of the first fixed jaw 52 of the button holder. This would be the initial position for the buttonhole presser device 24 and is the position from which the first bartack of a buttonhole should be implemented. For this particular arrangement where the work engaging shoe 40 is biased forwardly, it is possible by tugging upon the work material W in an attempt to move the work material into a correct position, that the work engaging shoe 40 may be moved to an incorrect position where the first bartack would be implemented in a position somewhere along the length of a buttonhole. Such a condition is shown in FIG. 2 in which the inner terminus 53 is separated from the cheek pieces 36 of the presser foot 34, mispositioning the work engaging shoe 40, as evidenced by the position of the target 68 on the non-reflecting area 60 instead of on the reflecting area 58.

If the work engaging shoe 40 is permitted to remain in the incorrect position, and a first bartack is implemented somewhere within the length of the buttonhole, it will be understood by those skilled in the art that the final leg of the buttonhole will extend beyond this initial bartack instead of terminating thereat. In the prior art as taught in U.S. Pat. No. 4,181,087, assigned to the same assignee as the instant invention and hereby incorporated by reference herein, this was sought to be corrected by providing for an initial step of feeding the work engaging shoe 33 to the initiating position by a finite number of, for example, three feeding steps. It is proposed in this invention to provide means for determining the position of the work engaging shoe 40 and to initiate only that number of feeding steps required to place the work engaging shoe in the initiating position. Thus, in FIG. 3, the optical sensors 30, 32 are aligned with the extensions 56, 62 to the button gauging device 50, and the output of the sensors are passed to a sensing circuit 76 where the condition of the sensors is determined, and from thence to a logic block 78 where the proper response to the output of the sensors is determined for implementation in the feed control block 80. A truth table, FIG. 4, indicates the possible logic states attainable by the optical sensors 30, 32. For the condition where the work engaging shoe 40 should be most forwardly with respect to the presser foot 34 as its initial position, it is evident that the target 68 from which the light is reflected to the optical sensor 30 should be on the reflecting area 58 of the first extension 56. Similarly, the target area 70 from which light is reflected to the second optical sensor 32 should be on non-reflecting area 60 of the first extension 56. By reference to FIG. 4, it will be seen that logic state 3 satisfies such a condition. In this event, the logic block 78 would provide instructions to the feed control 80 that no feed correction is required and buttonhole stitching may be implemented directly, If, on the other hand, a condition exists such as is shown in logic state 1, a condition depicted in FIGS. 2 and 3 where the targets 68, 70 are located on the non-reflecting area 60 of the first extension 58, or on the non-reflecting area 66 of the second extension, the logic 78 directs the feed control 80 to implement reverse stitching, stitch by stitch, until such time as the target area 68 is located on the reflecting area 58 of the first extension 56. A similar situation would apply if the target area 68 was located on the non-reflecting area 66 of the second extension 62 and the target area 70 was located on the reflecting area 64 of that extension. In any event, corrective action is taken stitch by stitch until such time as state 3 is achieved. State 4 would be the condition where the targets 68, 70 are both impinging on reflecting areas 58 or 64, a state which cannot be achieved.

Referring now to FIG. 5, there are shown the steps in producing a buttonhole utilizing the invention. In FIG. 5, there is shown a situation which would arise if, for example, an operator tugged upon the work material to pull the work material into the correct location and, while so doing, moved the work engaging shoe 40 rearwardly with the inner terminus 53 of the first fixed jaw 52 away from the presser foot 34, so that the sewing needle 21 is held suspended above the work material W at the point 81. In this event, the logic block 78 would be in the logic state 1 or 2 shown in FIG. 4. The logic block 78 responds to these logic states by initiating a feed control signal to urge the work engaging shoe 40 into the proper position while simultaneously suspending endwise reciprocation of the needle bar 20. The signal from the logic block 78 would continue until such time as the logic block reaches the logic state 3 shown in FIG. 4, where the optical sensor 30 receives light from a target 68 situated upon the reflecting area 58 of the first extension 56 and the optical sensor 32 receives light from the target area 70 situated upon the non-reflecting area 60 of the first extension. At that point, feed control correction of the position of the work engaging shoe 40 ceases, and formation of the buttonhole is implemented.

In the example in FIG. 5, 5 reverse steps were shown as necessary during which time endwise reciprocation of the sewing machine needle bar would be interrupted for example, by a device disclosed in U.S. Pat. No. 3,872,809, issued on Mar. 25, 1975 to Adams et al, which patent is assigned to the same assignee as the instant application and is hereby incorporated by reference herein. Thus, these 5 feed steps required to move the work engaging shoe 40 to the proper initiating position are performed without stitching in the work material, the stitching being initiated only when the actual buttonhole is being implemented. Thereafter, with the work engaging shoe 40 in its proper position, the first bartack and left side cording stitches are implemented. The second bartack and stitches overlying the left cording stitches may then be implemented. The needle bar thereupon shifts to the right side of the buttonhole to implement the right cording stitches and, finally, the right stitches overlying the cording stitches are implemented and the buttonhole is complete.

FIG. 6 discloses a prior art buttonhole, as it would appear with the first bartack misplaced, if the initial reversing stitches 82 had not been implemented by this invention. In this event, the bartack would have been misplaced to a position where the buttonhole would be unusable.

In FIG. 7 there is disclosed a circuit which may be used to sense the position of the work engaging shoe 40 by detecting the position of the extensions 58, 62 thereof. The optical sensors 30, 32 respond to the reflecting or non-reflecting areas in any one of three possible ways conforming to the possible logic states 1, 2 and 3. Thus, if the sensors respond to the non-reflecting areas 60, 66, there will be a 0 balance voltage at the point A in the circuit due to the bias voltage of equal but opposite polarity on the optical sensors 30, 32. This 0 input to buffer amplifier 86 will cause 0 output therefrom. A pair of voltage comparators 88, 90 compare the incoming voltages to the voltages set by potentiometers 92, 94 respectively, and transfer signals along lines 98, 100 to logic in an LSI to indicate the existence of the logic state 1 due to the target areas 68, 70 of the optical sensors 30, 32 on the non-reflecting surfaces 60, 66. The logic 78 converts this information to the appropriate action of suspending the endwise reciprocation of the needle bar 20 and initiating a feeding of the work engaging shoe 40 into its initial position. The position of the first and second extensions 56, 62 are continually monitored until the logic state 3 is achieved, at which point the logic 78 initiates implementation of the buttonhole.

In FIG. 8 there is disclosed, schematically, a mechanical switch which is normally mounted in the head end 18 of the sewing machine 10 for cooperation with the buttonhole presser device 24 to determine the turn around points at the end of the buttonhole. Such a device is disclosed in U.S. Pat. No. 4,159,688, issued on July 3, 1979, to the same assignee as that of the instant invention, and which is hereby incorporated by reference and made a part of this application. This device is fashioned with a paddle 102 which is actuated by a pair of spaced lugs on the buttonhole presser device shown in the referenced patent to initiate new feeding information. Such a device may be directly adapted to use as herein disclosed by direct connection thereof to a logic, and in which contact between the source of power and stationary contact S would indicate that the work engaging shoe 40 is in the initial position, any other state requiring a correction to this state. Thus, whenever the paddle 102 is moved by lugs on the buttonhole presser device 24 into engagement with stationary contact S, the initial state is known to exist and buttonholing may be implemented.

We claim:

1. A method of initiating the stitching of a buttonhole by a zig zag sewing machine having means for selectively reversible work material feeding, and a buttonhole presser device having a sliding portion for travelling with a work material during the formation of a buttonhole, said sliding portion of said presser device having an initial position from which actuation of said buttonhole is initiated, which method comprises the steps of:

a. sensing the position of the sliding portion of the buttonhole presser device;

b. determining whether the sliding portion of the buttonhole presser device is in the correct initial position for buttonholing; and, c. initiating corrective feed action if the sliding portion of the buttonhole presser device is not in the correct initial position, to move the same to the correct initial position.

* * * * *